US009289734B2

(12) United States Patent
Solera et al.

(10) Patent No.: US 9,289,734 B2
(45) Date of Patent: Mar. 22, 2016

(54) APPARATUS FOR THE DELIVERY OF FLUID PRODUCTS

(75) Inventors: Giuliano Solera, Mirandola (IT); Daniele Dall'Olio, Massa Finalese (IT)

(73) Assignee: CPS COLOR EQUIPMENT SA CON UNICO SOCIO, San Felice Sul Panaro (IT)

( * ) Notice: Subject to any disclaimer, the term of this patent is extended or adjusted under 35 U.S.C. 154(b) by 285 days.

(21) Appl. No.: 13/983,740

(22) PCT Filed: Feb. 2, 2012

(86) PCT No.: PCT/IB2012/000172

§ 371 (c)(1), (2), (4) Date: Oct. 23, 2013

(87) PCT Pub. No.: WO2012/104716

PCT Pub. Date: Aug. 9, 2012

(65) Prior Publication Data

US 2014/0299626 A1 Oct. 9, 2014

(30) Foreign Application Priority Data

Feb. 3, 2011 (IT) ..... UD2011A0014

(51) Int. Cl.
*B67D 1/16* (2006.01)
*B01F 13/10* (2006.01)
*B05B 15/02* (2006.01)

(52) U.S. Cl.
CPC ..... *B01F 13/1058* (2013.01); *B05B 15/0208* (2013.01); *B01F 2215/005* (2013.01)

(58) Field of Classification Search
CPC ..... B01F 13/1058; B01F 2215/005; B05B 15/0208
USPC ..... 222/129, 132, 136, 144, 144.5, 167, 222/325, 33, 63; 221/113, 119
See application file for complete search history.

(56) References Cited

U.S. PATENT DOCUMENTS 2,445,216 A * 7/1948 Foltz ..... B01F 7/1695 366/198
3,015,415 A * 1/1962 Marsh et al. ..... 222/14
(Continued)

FOREIGN PATENT DOCUMENTS

WO WO 2006/106540 A1 10/2006
WO WO 2012/104723 A1 8/2012

OTHER PUBLICATIONS

International Search Report and Written Opinion for PCT/IB2012/000172 mailed Apr. 17, 2012, 4 pages.
(Continued)

*Primary Examiner* — Paul R Durand
*Assistant Examiner* — Randall Gruby
(74) *Attorney, Agent, or Firm* — Flaster/Greenberg P.C.

(57) ABSTRACT

Apparatus for the delivery of fluid products comprising at least a base support, a plurality of dispensing units of said fluid products contained in containing receptacles by means of respective dispensing nozzles, wherein said dispensing units are disposed on a platform selectively rotatable with respect to said base support, in order to dispose at least one of said dispensing units in at least a first position in which said fluid products are suitable to be delivered from said containing receptacles to a container associated with said base support, by means of a corresponding pumping device, and wherein at least a drive member is disposed on said base support and is suitable to be kinematically connected to one or more pumping devices, first rapid connection means are provided to achieve at least one of either the connection of at least one of said dispensing nozzles with at least one of said dispensing units, or the connection between first kinematic connection means suitable to be selectively connected to said drive member and second kinematic connection means connected to said pumping device.

18 Claims, 11 Drawing Sheets

(56) References Cited

U.S. PATENT DOCUMENTS 3,042,259 A * 7/1962 Eugel ..... 222/33
3,122,272 A * 2/1964 Marsh ..... 222/26
4,258,759 A * 3/1981 Achen ..... B01F 13/1055 141/100
4,792,236 A * 12/1988 Heinis ..... B01F 13/1058 366/199
4,817,688 A * 4/1989 Corniea ..... B65B 39/02 141/140
4,869,397 A * 9/1989 Corniea ..... B65B 39/02 141/147
4,903,740 A * 2/1990 Corniea ..... B65B 39/02 141/1
5,078,302 A * 1/1992 Hellenberg ..... 222/144
5,356,041 A * 10/1994 Hellenberg et al. ..... 222/135
5,474,211 A * 12/1995 Hellenberg ..... 222/1
5,638,986 A * 6/1997 Tuominen ..... B01L 3/0293 222/1
5,645,114 A * 7/1997 Bogen ..... B01L 3/0293 141/130
5,711,458 A * 1/1998 Langeveld ..... B01F 13/1058 222/144
5,938,080 A * 8/1999 Haaser et al. ..... 222/144
5,947,167 A * 9/1999 Bogen ..... B01L 3/0293 141/1
6,273,298 B1 * 8/2001 Post ..... B65D 77/06 222/105
6,360,961 B1 * 3/2002 Marazzi ..... B01F 7/1625 239/104
6,412,658 B1 * 7/2002 Bartholomew et al. ..... 222/1
6,457,607 B1 * 10/2002 Andrea ..... B01F 13/1055 222/209
7,217,392 B2 * 5/2007 Bogen et al. ..... 422/64
D694,300 S * 11/2013 Sathe ..... D15/199
9,073,026 B2 * 7/2015 Engels et al.
2002/0010528 A1 * 1/2002 Bartholomew et al. ..... 700/239
2004/0159676 A1 * 8/2004 Adema ..... B01F 13/1058 222/144
2004/0262330 A1 * 12/2004 Voskuil ..... F16K 11/0876 222/144
2005/0194403 A1 9/2005 Mink
2005/0269367 A1 * 12/2005 Post ..... 222/185.1
2006/0169718 A1 * 8/2006 Buining et al. ..... 222/144
2006/0175570 A1 * 8/2006 Held ..... B01F 13/1058 251/315.03
2006/0175571 A1 * 8/2006 Held ..... B01F 13/1058 251/315.03
2007/0044863 A1 * 3/2007 Engels et al. ..... 141/83
2007/0084520 A1 * 4/2007 Driessen ..... B01F 13/1058 141/2
2007/0138203 A1 * 6/2007 Sacchet ..... B01F 13/1058 222/144
2008/0047972 A1 2/2008 Bartholomew
2009/0236367 A1 * 9/2009 Voskuil et al. ..... 222/144
2011/0075510 A1 * 3/2011 Sacchet ..... B01F 13/1058 366/152.2
2011/0290823 A1 * 12/2011 Miller ..... 222/132
2012/0018034 A1 * 1/2012 Bertoli et al. ..... 141/9
2012/0031926 A1 * 2/2012 Bertoli et al. ..... 222/144
2012/0104037 A1 * 5/2012 Ben-Shoshan ..... 222/1
2012/0145263 A1 * 6/2012 Solera et al. ..... 137/565.17
2012/0175383 A1 * 7/2012 Engels et al. ..... 222/135
2012/0175385 A1 * 7/2012 Voskuil ..... 222/144
2013/0111849 A1 * 5/2013 Bush ..... B01F 9/0001 53/167
2013/0277594 A1 * 10/2013 Voskuil ..... 251/324
2014/0352843 A1 * 12/2014 Solera et al. ..... 141/104
2015/0060482 A1 * 3/2015 Murray et al. ..... 222/1

OTHER PUBLICATIONS

International Search Report and Written Opinion for PCT/IB2012/000190 mailed Apr. 24, 2012, 5 pages.

* cited by examiner

APPARATUS FOR THE DELIVERY OF FLUID PRODUCTS

BACKGROUND OF THE INVENTION

1. Field of the Invention

The present invention concerns an apparatus for the delivery of fluid products such as colorant products, food products or other, in particular the fluid products can be colored pigments, of different shades or color, able to be measured out and/or added to a base substance to form a varnish or paint.

2. Description of Related Art

Apparatuses are known for delivering fluid products, semi-fluids, pastes, gels or creams, such as colorant products, food products or other. Known delivery apparatuses comprise a plurality of containing receptacles or canisters, each suitable to contain a predetermined fluid, colorant or food product and connected to an associated dispensing unit, such as a piston or a bellows pump.

The receptacles, and the associated dispensing units, are mounted on a rotatable platform suitable to position the dispensing units in correspondence to a delivery position, according to a predetermined sequence. In the delivery position, a specific dispensing unit is selectively activated to deliver a desired quantity of the fluid of the corresponding containing receptacle toward an outlet container, allowing it to be filled with one or more of the fluids in order to obtain a fluid according to a desired composition and/or formula.

Each receptacle is also provided with stirring means connected, by means of a cam profile, to a movement member which keeps the fluid product contained therein constantly mixed.

One disadvantage of known apparatuses is that they are complex to achieve, and provide a plurality of elements to be assembled and attached according to a predetermined assembly order, for example attaching them to a framework, using various assembly equipment and hardware items, such as screws, nuts, screw studs, bolts or suchlike.

For this reason, known apparatuses are normally assembled or pre-assembled in the factory and delivered to the final user. This entails high costs of packing and transporting the apparatuses because of their bulk.

Moreover, any maintenance operations, such as for example the removal of the rotatable platform to intervene on its movement members, the substitution of some receptacles to subject them to cleaning or reloading, and the need to intervene on the delivery units themselves, entail long intervention times and must be carried out by specialized personnel having specific technical know-how.

BRIEF SUMMARY OF THE INVENTION

Purpose of the present invention is to achieve a delivery apparatus which allows a reduction in assembly and/or maintenance costs and which allows non-specialized personnel to carry out maintenance operations.

The Applicant has devised, tested and embodied the present invention to overcome the shortcomings of the state of the art and to obtain these and other purposes and advantages.

The present invention is set forth and characterized in the independent claim, while the dependent claims describe other characteristics of the invention or variants to the main inventive idea.

In accordance with the above purpose, an apparatus for the delivery of fluid products comprises a base support possibly associated with a base and a plurality of dispensing units of the fluid products which are contained in containing receptacles. The dispensing units are disposed on a platform selectively rotatable with respect to the base support, in order to dispose at least one of them in at least a first position in which the fluid products are delivered, by means of respective dispensing nozzles, from the receptacles toward a container for their subsequent use, transport and storage.

The receptacles are advantageously associated with the platform and comprise stirring means suitable to keep the fluids contained therein mixed.

The dispensing units each comprise at least a pumping device to deliver the fluid product and in which at least a drive member is disposed on the base support and is suitable to be connected kinematically to one or more pumping devices.

More particularly, the platform rotates, in the two directions of rotation—clockwise and anti-clockwise—to sequentially position, in different temporal instants and according to one or more predetermined sequences, the desired and selected dispensing unit in a corresponding delivery position, in which the drive member is coupled in order to drive the pumping device and deliver predetermined quantities of fluid into the container in order to obtain a final product with a desired final composition and/or formula.

According to one feature of the present invention, first rapid connection means are provided to achieve at least one of either the connection of at least one of the dispensing nozzles with at least one of the dispensing units, or the connection of the first kinematic connection means, suitable to be selectively connected to the drive member and second kinematic connection means connected to the pumping device.

Here and hereafter in the description and the claims, by rapid connection means we mean connections of the snap-in type, bayonet, joint type or by interference, that is, mechanical connections between two parts comprising respective portions which are joined to each other by means of same-shape coupling, making it unnecessary to use suitable attachment means such as screws, nuts, screw studs, threaded seatings or suchlike.

In this way it is possible to assemble/disassemble the delivery apparatus and its devices and accessories in a rapid and simple way, avoiding the use of specific connection and attachment instruments and members, such as screws, nuts and bolts or others. It is therefore possible to considerably reduce the assembly times both during the production of the apparatus and also during its maintenance, allowing it to be delivered and transported in a disassembled or partly assembled condition, also reducing the costs of packaging, storage and transport.

According to one feature of the invention, the first rapid connection means are the bayonet type, and comprise at least a first seating, substantially L-shaped and made on a covering element of the dispensing unit, and at least a peg made on the dispensing nozzle and suitable to be inserted stably inside the first seating with a vertical movement and a subsequent partial rotation, to prevent the removal of the dispensing nozzle from the covering element.

According to one form of embodiment, the dispensing nozzle comprises an external body, a cover connected to the external body by means of second rapid connection means and a first hermetic sealing element interposed, in a through seating made in the external body, between the external body and the cover and suitable to prevent the residual fluid products from drying up, which might close the emission aperture of the fluid products for subsequent deliveries.

According to another form of embodiment, the second rapid connection means comprise at least a protrusion made on the external surface of the cover, and at least a corresponding circumferential eyelet conformed to accommodate the protrusion, and to determine a same-shape coupling between the cover and the external body.

According to a variant, between the first hermetic sealing element and the external body a spacer element is interposed, suitable to keep in abutment, in the through seating, a second hermetic sealing element against the external body and respectively the first hermetic sealing element against the cover. Moreover, third rapid connection means are provided in the spacer element and in the second hermetic sealing element, in order to carry out their reciprocal connection. The presence of two hermetic sealing elements allows to limit, if not eliminate, problems connected to the drying out of the fluid products and in particular the second sealing element provides to contain the fluid product inside the pumping device, and to prevent it from drying out which in that case would entail replacing the whole pumping device, with considerable maintenance costs.

According to one form of embodiment, the third rapid connection means comprise at least a first coupling tooth made on the external surface of the spacer element and at least a corresponding circumferential eyelet made on the external body and conformed so as to couple in snap-in mode with the first tooth.

According to another feature, the first kinematic connection means comprise an actuator element conformed to selectively couple with the drive member and to be made to rotate by the latter, and the second kinematic connection means comprise a drive element connected to the actuator element and suitable to drive the pumping device. Moreover, the first rapid connection means comprise at least a second seating made in the drive element and at least an attachment tooth made in the actuator element which, coupling with each other, allow the reciprocal connection of the drive element and actuator. It is advantageous to provide that the actuator element and the drive element are made as separate bodies, instead of as a single body, because then mechanical connection elements, such as bearings, pins, bronzes or suchlike, may be interposed between them.

According to another feature, the apparatus comprises a first cam element associated with the platform and suitable to be made to rotate with respect to it by means of a first motor associated with the base support, and a plurality of second cam elements, drivable by the first cam element, in order to move the stirring means suitable to mix the fluid products contained in the receptacles. Moreover, at least one of the second cam elements is rotatably associated with the platform by means of fourth rapid connection means.

According to one form of embodiment, the fourth rapid connection means comprise a support pin for the connection of the second cam element to the platform which is provided at least with a second tooth suitable to connect the support pin in a corresponding hole of the platform.

According to a variant, the fourth rapid connection means also comprise a third tooth provided on the support pin suitable to connect to each other the support pin and a bearing suitable to allow the rotation of the second cam element around the support pin, and a fourth interference tooth made in the second cam element and suitable to establish a stable coupling of the latter with the bearing.

According to another variant, the second rapid connection means comprise at least a weakening notch made in proximity to the second tooth and/or to the third tooth, to increase the elastic malleability of the latter and to promote the insertion respectively of the support pin inside the hole of the platform and of the bearing in the support pin.

The first motor is associated with the base support by means of fifth rapid connection means comprising a shaped seating made in the base support and an interference element conformed substantially like the shaped seating and suitable to assume a first position in which the interference element is suitable to be inserted in the shaped seating, and a second position in which the interference element is suitable to be rotated in order to prevent the removal of the motor from the base support, given that the interference element will abut against the surface surrounding the shaped seating.

According to another variant, the base support comprises at least a button which can be selectively activated by a user and comprising a protruding element associated with the base support and suitable to accommodate at least a switch and a cover conformed to allow the selective drive of the switch. Moreover, sixth rapid connection means are suitable to connect the protruding element and the cover with each other, so as to close inside it the switch, which can be suitable to set particular commands for the apparatus, such as for example its rotation or stoppage during one delivery step or other.

According to another feature, the base support comprises a plurality of small drip-catcher channels suitable to collect residues of the fluid products delivered by the dispensing nozzles, and in particular the drip-catcher channels are provided with seventh rapid connection means suitable to cooperate with the base support and to attach the drip-catcher channels to the latter.

According to a variant, at least one of the drip-catcher channels is provided with cleaning means to clean the dispensing nozzles, comprising an element containing a cleaning liquid, a brush disposed in the containing element and suitable to contact the dispensing nozzle in order to remove possible fluid delivered, a pin suitable to support the brush in a rotatable manner on supports provided in the containing element and a second motor suitable to make the brush rotate around the pin. The brush is suitable to be attached to the pin by means of eighth rapid interference connection means. In particular the brush is made of elastic material and its coupling hub with the pin has a diameter slightly smaller than the diameter of the pin, so that the brush is inserted into the pin by means of interference and exploiting the elastic malleability of the material it is made of.

The brush also has a plurality of fins suitable to contact the dispensing nozzle, also deforming, and to remove from its surface any possible residues of fluid product delivered that has remained on the delivery nozzle.

BRIEF SUMMARY OF THE SEVERAL VIEWS OF THE DRAWINGS

These and other characteristics of the present invention will become apparent from the following description of a preferential form of embodiment, given as a non-restrictive example with reference to the attached drawings wherein.

To facilitate comprehension, the same reference numbers have been used, where possible, to identify identical common elements in the drawings.

DETAILED DESCRIPTION OF THE INVENTION

Figure 1:
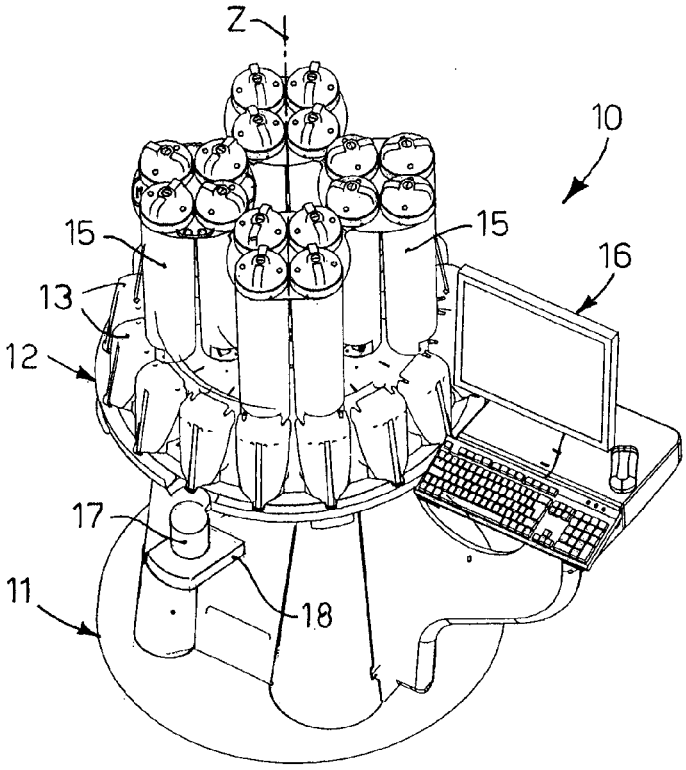
FIG. 1 is a perspective view of a delivery apparatus according to the present invention.

With reference to FIG. 1, an apparatus to deliver fluid products according to the present invention is indicated in its entirety by the number 10 and comprises, in its essential parts, a base 11 to support a rotatable platform 12, also called turntable, provided with a plurality of dispensing units 13 of the fluid product, which is contained in a corresponding number of receptacles, or canisters 15.

A bracket 18 is associated with the base 11 and is able to support a container 17, in which a base substance is contained, for example.

A processing unit 16 is suitable to command the rotation of the rotatable platform 12 and to dispose the dispensing units 13 in correspondence to the container 17 below and to command the delivery of the fluid products into the container.

Between the rotatable platform 12 and the base 11*a* base support 20 (FIG. 2) is disposed, which is solidly attached to the base 11 with attachment means of the snap-in type, which will be described in more detail hereafter.

In particular the rotatable platform 12 can rotate with respect to the base support 20, in the two directions of rotation, clockwise and anticlockwise, indicated by the arrow R around a vertical axis of rotation Z.

The base support 20 (FIG. 2) is substantially disc-shaped, and comprises, on its upper surface, a plurality of stiffening ribs to give structural resistance to it, in order to better support both the rotatable platform 12 and the receptacles 15.

Figure 2:
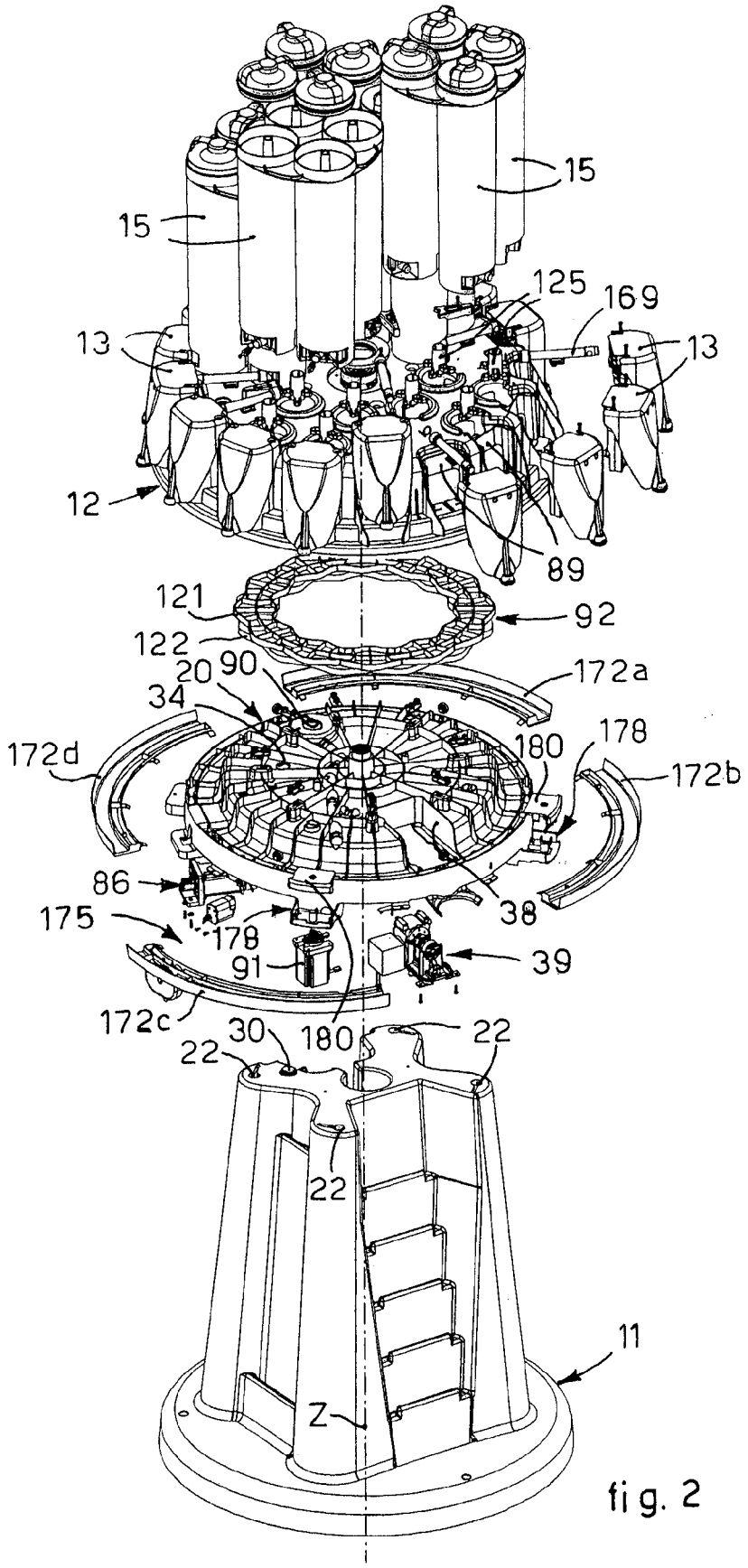
FIG. 2 is an exploded view of the apparatus in FIG. 1.
Figure 3:
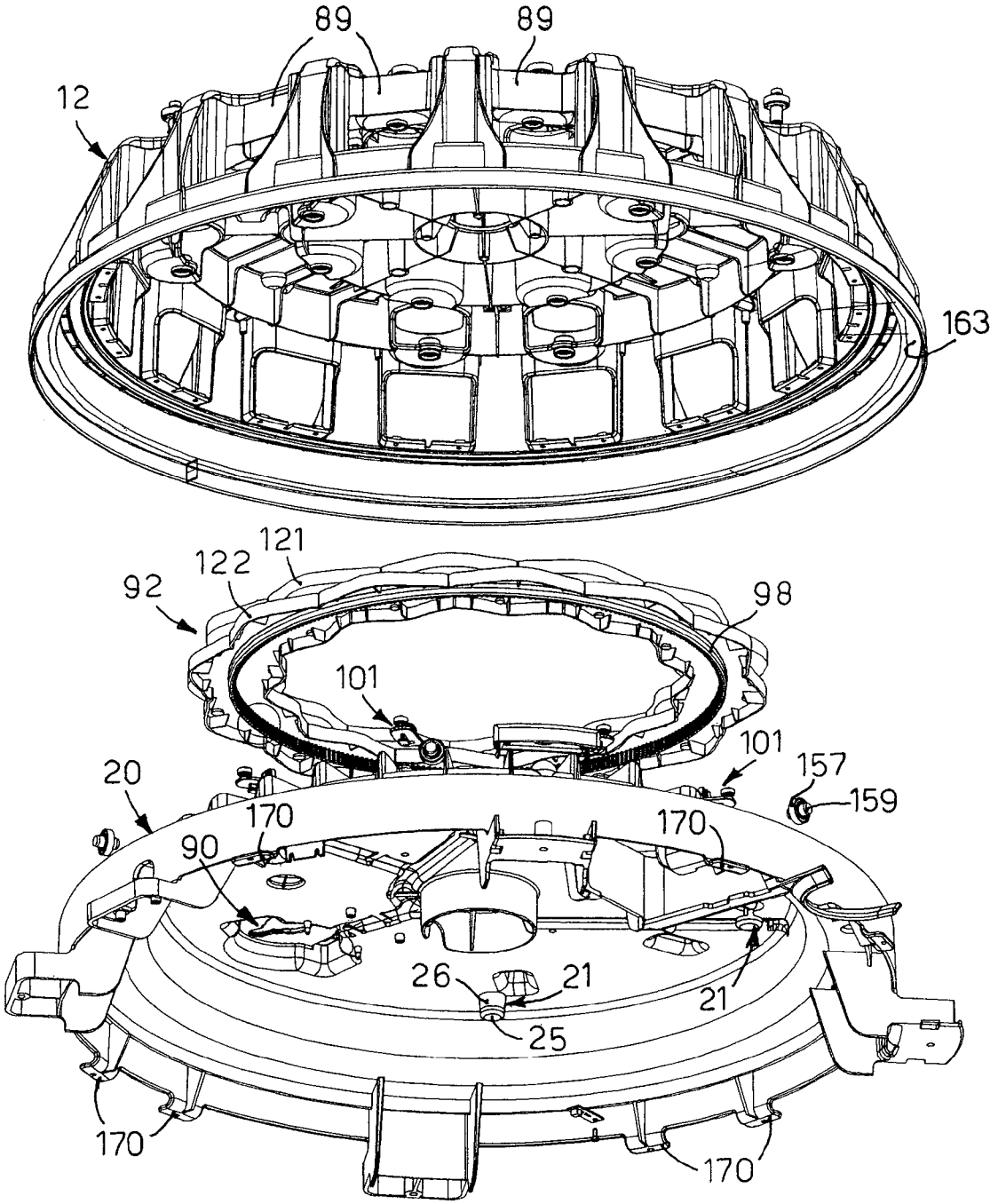
FIG. 3 is an enlarged view from below of a detail of FIG. 2.

The base support 20 (FIG. 3) is provided with four clamping elements 21 on its lower surface, which are suitable to be inserted in suitable first eyelets 22 made on the upper part of the base 11 (FIG. 2).

The clamping elements 21 (FIG. 5) of the base support 20 comprise a head 25 and a connection portion 26, between the latter and the base support 20, having at least a reduced width with respect to that of the head 25.

Figure 4:
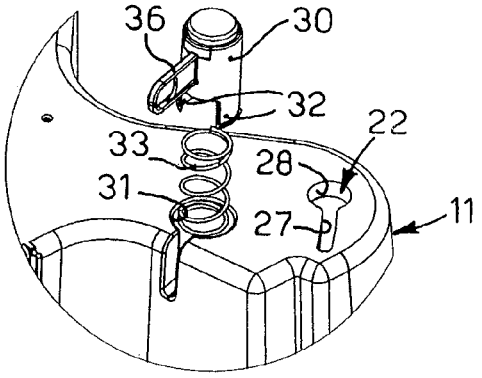
FIG. 4 is an enlarged view of a first detail of FIG. 2.

The first eyelets 22 (FIG. 4) are shaped so that each has a first portion 27 and a second portion 28 of a greater width with respect to the first and through which the head 25 of the first clamping elements 21 can be inserted.

The base support 20 (FIG. 2) is disposed above the base 11 so that each of the heads 25 of the first clamping elements 21 are inserted inside the second portion 28 of the first eyelets 22 of the base 11. Subsequently, making the base support 20 rotate toward the first portion 27 of each first eyelet 22 it is vertically clamped with respect to the base 11.

Figure 5:
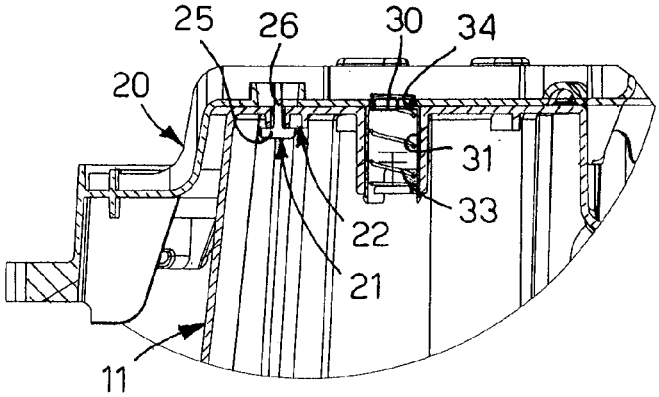
FIG. 5 is a section view of a detail of FIG. 4.

In order to clamp the rotation of the base support 20, and prevent it from decoupling from the base 11, the latter is provided with a clamping button 30 (FIG. 4) which is associated with the upper part of the base 11. In particular, the latter has a first seating 31 which is substantially blind, and provided on the bottom with at least two lateral apertures inside which two clamping teeth 32 of the button 30 are inserted (FIG. 5). The button 30 is inserted inside the first seating 31, the two clamping teeth 32 are inserted in the two lateral apertures of the first seating 31, constraining the axial sliding of the button and preventing it from coming out from the first seating 31.

A spring 33 is inserted inside the first seating 31 in abutment against its bottom, and is suitable to constantly maintain the clamping button 30 thrust upward. In this way the latter can complete a limited vertical travel inside the first seating 31.

The upper part of the button 30 is inserted in a through hole 34 made in the base support 20, in this way blocking the rotation of the latter.

If it is necessary to decouple the base support 20 from the base 11, it is sufficient to act on a grip portion 36 (FIG. 4) of the button 30 in order to release its upper part from the through hole 34 and subsequently make the base support 20 rotate with respect to the base 11 (FIG. 2).

A housing seating 38 is made in the base support 20 to house a drive unit 39 of the dispensing unit 13 which during the rotation is disposed in proximity to the bracket 18.

In particular, the base support 20 is mounted on the base 11 so that the housing seating 38 is located in cooperation with the bracket 18 on which the container 17 is located.

Figure 6:
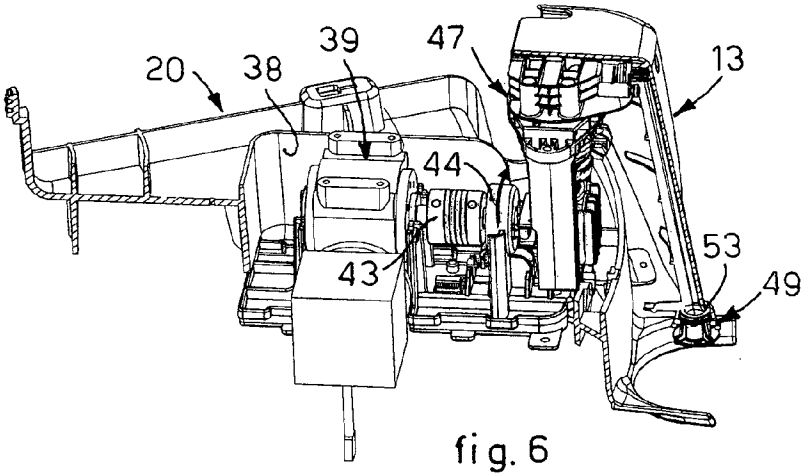
FIG. 6 is a partly sectioned view of a second detail of FIG. 2.

The drive unit 39 (FIG. 6) comprises at least a drive motor 43 commanded by the processing unit 16, which, by means of an actuator element 44, acts on the dispensing unit 13 to drive the delivery of the fluid product.

Figure 7:
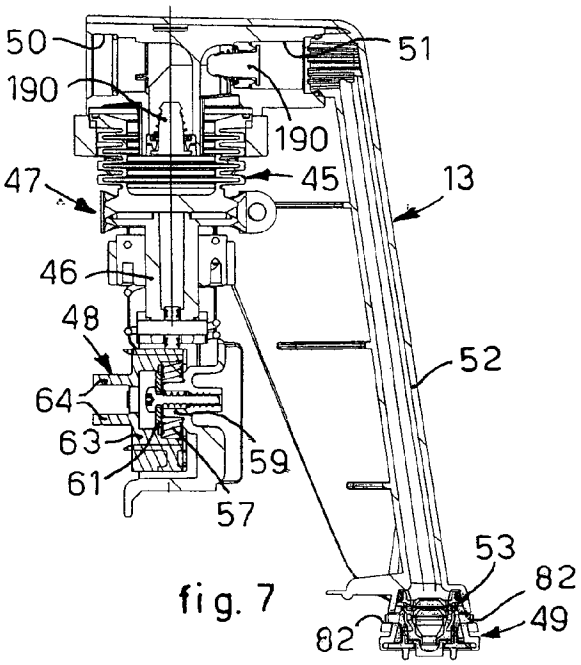
FIG. 7 is a section view of a part of the detail of FIG. 6.

The dispensing unit 13 (FIG. 7) comprises a delivery circuit 47 which, actuating an actuator element substantially conformed as a cam, hereafter referred to as cam element 48, acts on a pumping device, in this case a bellows pump 45 which, in turn, pumps the fluid product toward a dispenser nozzle 49. The fluid product is introduced into the delivery circuit 47 through an inlet pipe 50, and exits through an outlet pipe 51 in order to subsequently supply it to the dispenser nozzle 49.

A cover element or casing 52 is attached, and is placed to cover the delivery circuit 47 in known modes.

Figure 8:
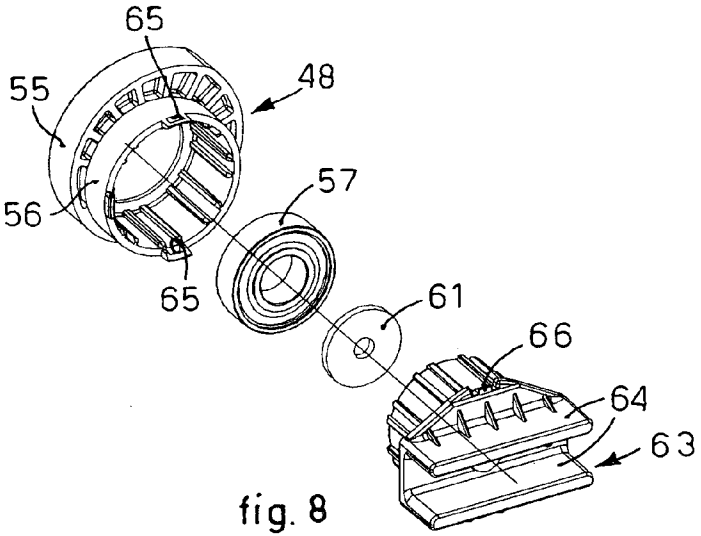
FIG. 8 is an exploded view of some components of FIG. 7.

The cam element 48 (FIG. 8) comprises a first part 55 and a second part 56 made in a single body, each of a substantially cylindrical shape and in which the first part 55 has a greater diameter than the second part 56.

The first part 55 is associated with the second part 56 with axes disposed staggered with respect to each other so that, when the second part 56 is made to rotate around its own axis, an eccentricity of the first part 55 is achieved which is converted into alternate motion for an actuation element 46 (FIG. 7) of the bellows pump 45.

The cam element 48 (FIG. 8) also comprises a bearing 57 for a sliding mounting on a pin 59, a holding element of the bearing 61 and an actuator element 63, solidly attached to the cam element 48, and having two command fins 64 which during the delivery step of the liquid product cooperate with the actuation element 44 (FIG. 6) of the drive motor 43 to bring the whole cam element 48 into rotation.

Figure 9:
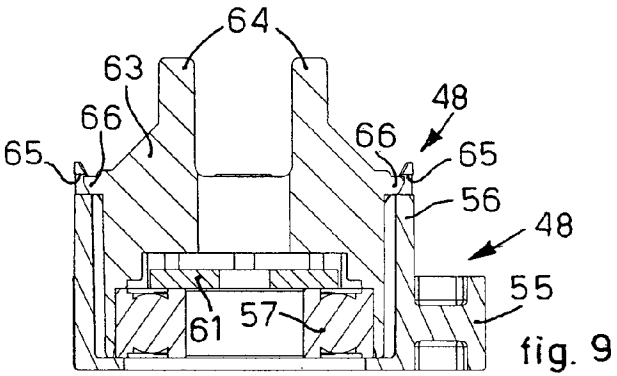
FIG. 9 is a section view of the components in FIG. 8 in an assembled condition.

The actuator element 63 (FIG. 9) keeps the bearing 57 in abutment on the pin 59 and is made solid with the cam element 48 by means of snap-in connections. Specifically, in the second part 56 (FIGS. 8 and 9) of the cam element 48 two second seatings 65 are made, suitable to cooperate with two respective attachment teeth 66 present on the actuator element 63.

Both the inlet pipe 50 (FIG. 7) and the outlet pipe 51 of the delivery circuit 47 comprise a non-return valve 190 which limits any refluxes of the fluid product.

Figure 14:
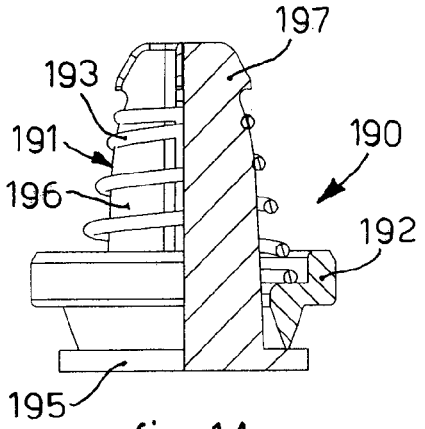
FIG. 14 is an enlarged and partly sectioned view of a component of FIG. 7.
Figure 15:
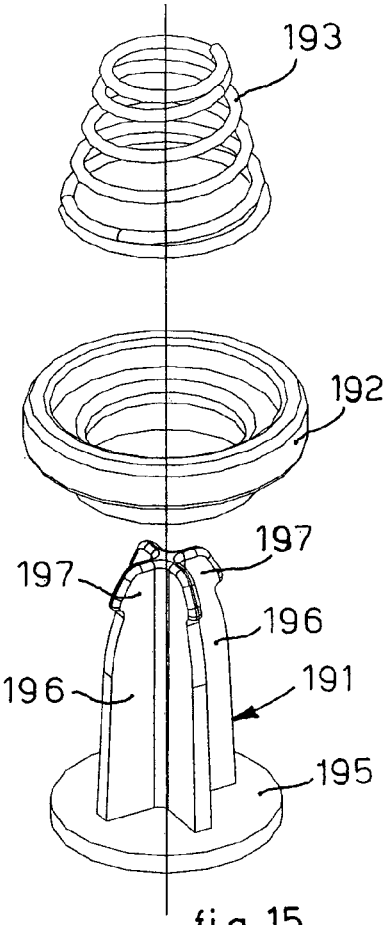
FIG. 15 is an exploded view of the components of FIG. 14.

Specifically each valve 190 (FIGS. 14 and 15) comprises a body, also called cartridge 191, an annular element 192 for coupling the valve 190 to the inlet 50 and outlet 51 pipes, and a restraining spring 193 of a substantially truncated cone shape.

The cartridge 191 is provided with a closing stopper 195 to close the pipes and with four ribs 196 which extend orthogonally and inclined toward the center, with respect to the stopper 195.

The ribs 196 terminate at the upper part with protuberances 197.

During use, the annular element 192 is inserted through the ribs 196 abutting against the stopper 195, and the spring 193, which is also inserted through the ribs 196, abuts against the annular element 192 and is held at the upper part against the protuberances 197 which prevent it from coming out.

Figure 11:
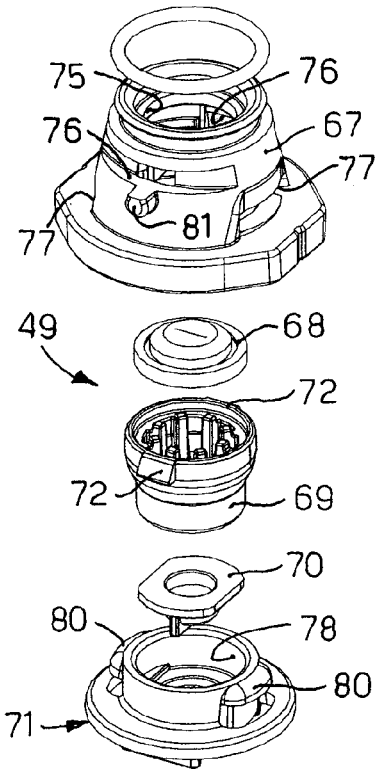
FIG. 11 is an exploded view of some components of FIG. 10.
Figure 12:
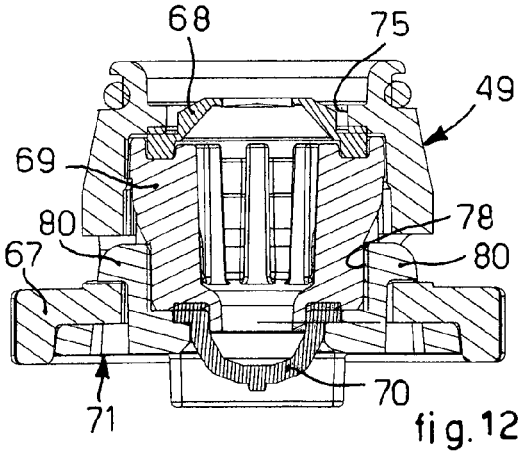
FIG. 12 is a section view of the components in FIG. 11 in an assembled condition.
Figure 13:
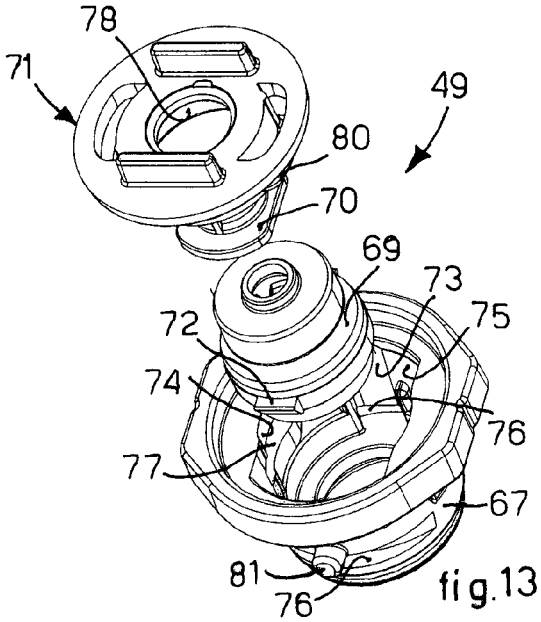
FIG. 13 is a view from below of the components of FIG. 11.

The dispenser nozzle 49 (FIGS. 11-13) comprises an external body 67, having a suitably shaped through hole 75 inside which a hermetic seal element is disposed, in this case a membrane 68, a spacer element 69, a hermetic seal 70 and a closing cover 71.

The spacer element 69 is connected to the external body 67 by means of a snap-in connection, while the closing cover 71 is connected to the external body 67 by means of a joint connection.

Specifically, the membrane 68 is inserted on the bottom of the external body 67 of the nozzle 49 and the spacer element 69 provides to keep it clamped and in position.

The external body 67 has four grooves made on the circumferential surface of the through hole 75, in an axial direction, made in opposite pairs and equally spaced with respect to each other. In particular (FIG. 13), a first pair of grooves 73 is disposed in continuity with two circumferential eyelets 76, which are also opposite each other, while a second pair of grooves 74 is disposed in continuity with two second circumferential eyelets 77.

The spacer element 69 is provided with two clamping teeth 72 which, in the assembly step of the nozzle 49, are inserted through the first pair of grooves 73, inside the two circumferential eyelets 76, impeding any axial decoupling and keeping the membrane 68 in the desired position.

The hermetic seal 70 (FIGS. 11 and 12) has the function of separating the air from the colorant to prevent it drying, and is inserted in a suitable through seating 78 made in the closing cover 71, and is associated with the external body 67 by means of two protuberances 80, made opposite to each other on the closing cover 71. The two protuberances 80 are inserted through the second pair of grooves 74, inside the second circumferential eyelets 77.

Figure 10:
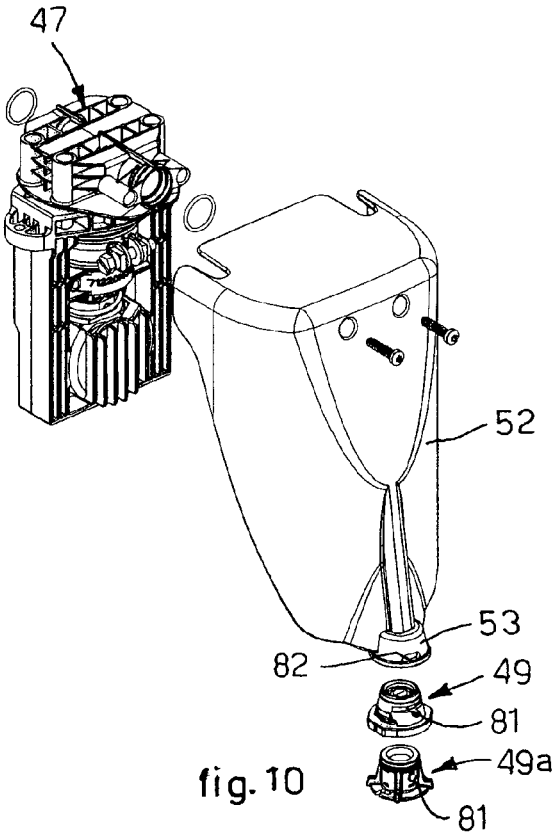
FIG. 10 is a perspective view of other components of FIG. 7, in a disassembled condition.

The external body 67 of the dispensing nozzle 49 has two pegs 81 on its external surface, opposite each other and which are able to be inserted in suitable two L-shaped seatings 82 (FIG. 10) made in proximity to an attachment end 53 of the casing 52, by means of a connection of the bayonet type.

In another form of embodiment, it may be provided that the dispenser nozzle is conformed as indicated by the reference number **49*a*, that is, compared to the dispenser nozzle 49 having centering ribs, advantageously inclined, instead of a substantially truncated cone surface. In this case too, the nozzle 49*a* is provided with pegs 81 to couple by means of bayonet connection with the respective L-shaped seatings 82 of the casing 52**.

The base support 20 (FIG. 2) is also provided with a second housing seating 90, made in an opposite position with respect to the first housing seating 38 and in which, when installed, an electric motor 91 is inserted which is able to cooperate with an annular cam element 92.

Figure 16:
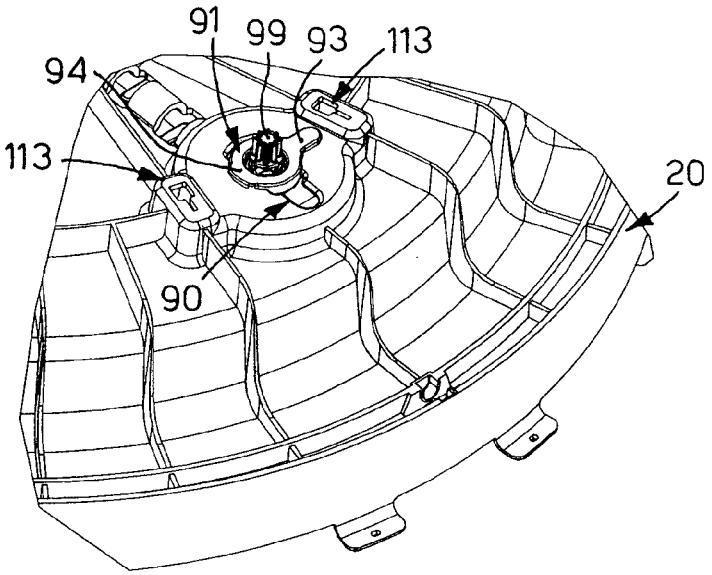
FIGS. 16 and 17 are an enlargement of a detail of FIG. 2.

Specifically, the second housing seating 90 (FIGS. 3 and 16) is shaped substantially like a key, and is suitable to allow the attachment of the electric motor 91 by means of an interference element having an oblong portion 93, an abutment portion 94 and a central portion 95, substantially cylindrical, provided between the oblong portion 93 and the abutment portion 94 made in a single body with the body of the electric motor 91.

During use, the oblong portion 93, the abutment portion 94 and the central portion 95 of the electric motor 91 are inserted in the second housing seating 90 and with subsequent rotation, the latter is clamped to the base support 20.

The annular cam element 92 is located concentric to the base support 20 and is made to rotate together with the rotatable platform 12, even in an independent manner with respect thereto, by means of the electric motor 91.

Figure 17:
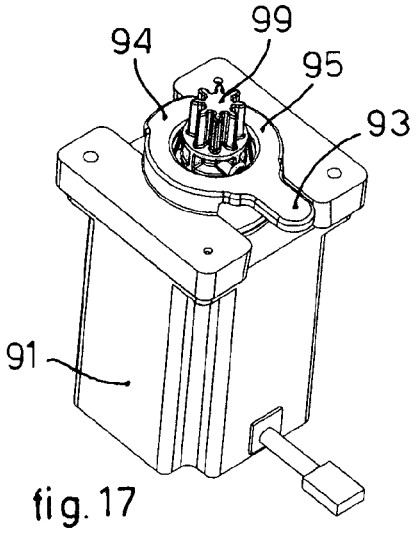
Figure 20:
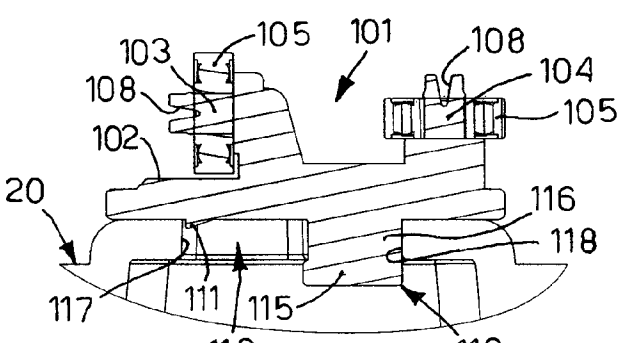
FIG. 20 is a section view of a fourth detail of FIG. 2 in an assembled condition.
Figure 21:
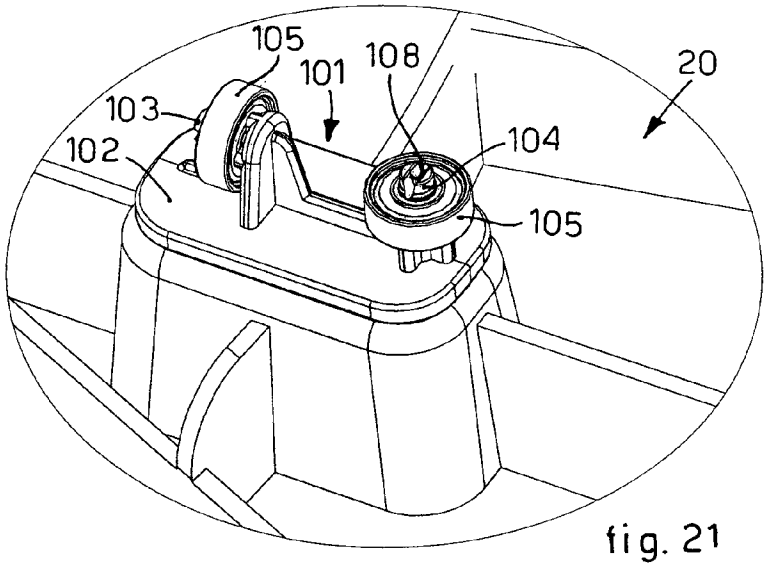
FIG. 21 is a perspective view of the detail of FIG. 20.
Figure 18:
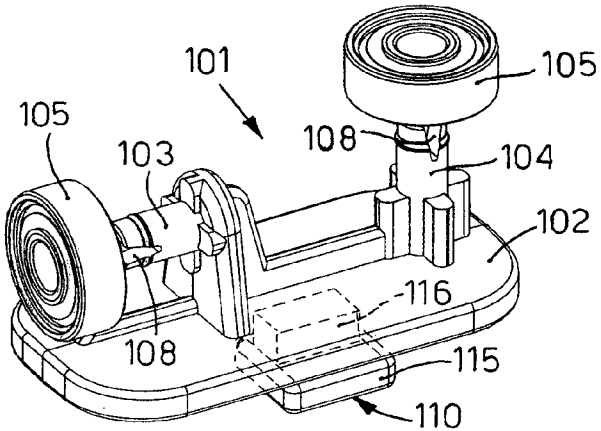
FIG. 18 is an exploded enlargement of a third detail of FIG. 2.
Figure 19:
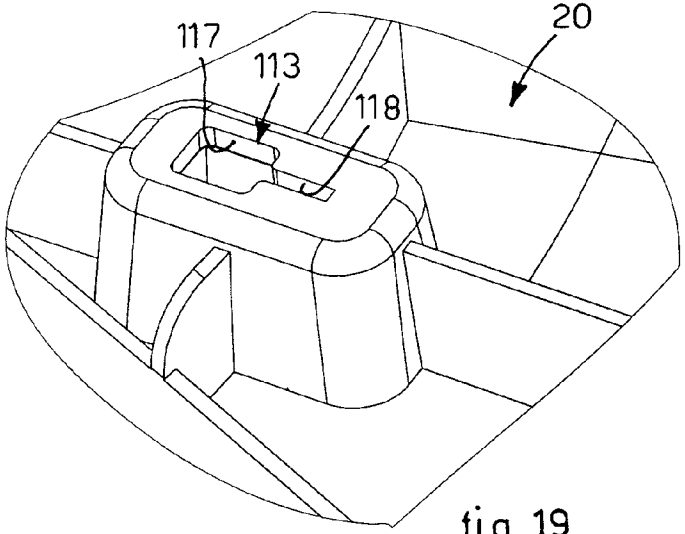
FIG. 19 is an enlarged view of a detail of FIG. 2.

In particular, on its lower surface, the annular cam element 92 (FIG. 3) is provided with a rack 98, which extends for the whole of its circumferential development, and is able to cooperate with a toothed wheel 99 (FIG. 17) which is keyed onto the drive shaft of the electric motor 91, which provides to make the annular cam element 92 rotate.

The annular cam element 92 (FIG. 2) rests sliding on a plurality of support elements 101.

Each support element 101 (FIGS. 18-21) is provided with a base 102, and a first 103 and a second 104 support pin, made in a single body with the base 102 and disposed, respectively, the first 103 parallel to the base 102 and the second 104 perpendicularly thereto.

Each of the two support pins 103, 104 is suitable to support respective bearings 105, and in proximity to its free end, is provided with respective attachment elements 108 of the snap-in type which provide to keep the respective bearings 105 in position.

The pair of bearings 105 provided on each support element 101 promotes the rotation of the annular cam element 92 (FIG. 3) and in particular, the bearing 105 mounted on the first support pin 103 contacts the lower surface of the annular cam element 92, preventing possible vertical oscillations during rotation, while the bearing 105 mounted on the second support pin 104 contacts the lateral and more external surface of the rack 98, constraining its rotation around the axis of rotation Z of the apparatus 10.

Each support element 101 (FIGS. 18-21), on the lower part of the base 102, is provided with a substantially T-shaped attachment element 110, and with a contrast tooth 111, both able to cooperate mechanically with a respective seating 113 made on the base support 20.

Specifically, the T-shaped attachment element 110 comprises a substantially rectangular base portion 115, and a connection portion 116 connecting the base portion 115 to the lower surface of the base 102 of the support element 101.

The connection portion 116 has a width which is less than the width of the base portion 115.

Each seating 113, made on the base support 20, is substantially "T" shaped, and comprises a first portion 117, substantially rectangular and mating with the base portion 115 of the attachment element and a second portion 118 with a reduced width and substantially equal to the thickness of the connection portion 116 of the T-shaped attachment element 110.

The support element 101 is then solidly associated with the base support 20, inserting the base portion 115 of the T-shaped attachment element 110 inside the first portion 117 of the seating 113, and subsequently, making the support element 101 slide toward the second portion 118 inside the first portion 117, the insertion of the connection portion 116 inside the latter is determined.

During the sliding, the contrast tooth 111 is inserted inside the first portion 117 of the seating 113 determining an impediment to the sliding, given that both the connection portion 116 and the contrast tooth 111 are confined inside two opposite surfaces of the seating 113.

The annular cam element 92 (FIG. 3) comprises a first shaped part 121 and a second shaped part 122 which is lower with respect to the first 121, each shaped so as to have both an external edge and an internal edge provided with a curvilinear shape and both provided with concave and convex portions.

In particular, the concave and convex portions respectively of the first shaped portion 121 are disposed staggered by one step with respect to the concave and convex portions of the second shaped part 122.

Figure 22:
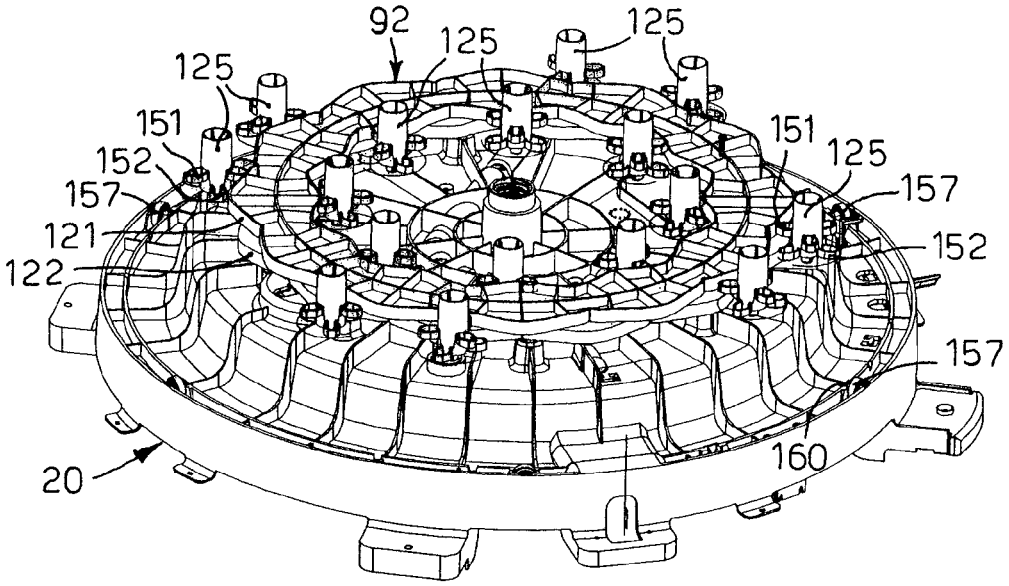
FIGS. 22 and 23*a* are other enlarged details of FIG. 2.
Figure 25:
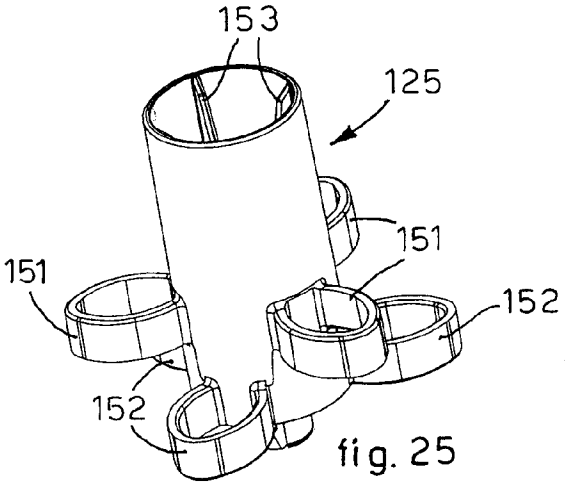
FIG. 25 is a view of another detail of FIG. 2.

The internal and external edges of the two shaped parts 121 and 122 (FIG. 22) of the annular cam element 92 are conformed to cooperate with second cam elements 125 (FIG. 25), in equal number to the number of seatings 89 made in the rotatable platform 12 (FIG. 2).

The second cam elements 125 are inserted in compartments 126 (FIG. 27) made in the rotatable platform 12 concentric with respect to the axis Z.

Figure 24:
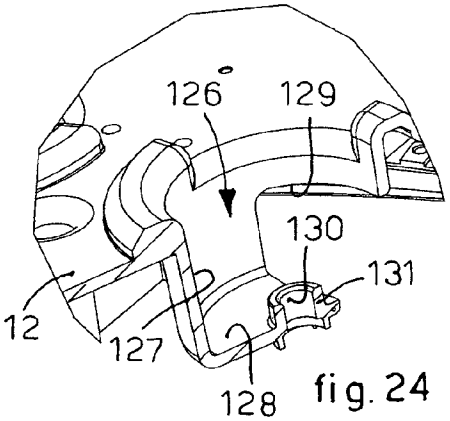
FIG. 24 is a partly sectioned view of a component of FIG. 23*a;*

The compartments 126 (FIG. 24) are provided with a lateral wall 127 and a bottom wall 128 in both of which an aperture 129 is made, into which, during use the annular cam element 92 is partly inserted.

The bottom wall 128 is provided with a through hole 130 which is surrounded by a stiffening edge 131.

Figure 27:
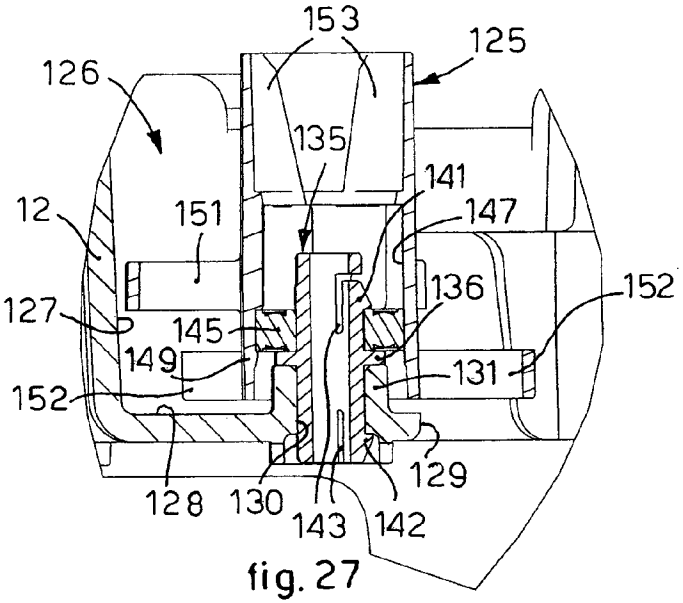
FIG. 27 is a section view of the detail of FIG. 25 in an assembled condition.
Figure 26:
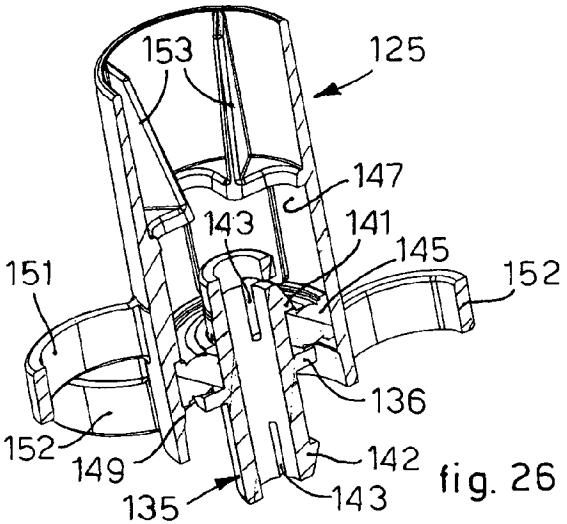
FIG. 26 is a perspective and partly sectioned view of the detail of FIG. 25.

A support pin 135 suitable to support one of the second cam elements is inserted into the through hole 130 (FIGS. 26 and 27).

The support pin 135 comprises a shoulder 136 which during use abuts against the stiffening edge 131 of the through hole, and each of the two opposite ends is provided respectively with a first clamping tooth 141 and a second clamping tooth 142 both of the snap-in type.

Both the first tooth 141 and the second tooth 142 cooperate with a notch 143 made on the body of the support pin to confer malleability when the clamping occurs.

Specifically the first clamping tooth 141 allows to clamp a bearing 145 which, during use, abuts against the shoulder 136 and is held, precisely, by the first clamping tooth 141.

The second clamping tooth 142 allows to hold the support pin 135 inside the through hole 130 between the two surfaces, lower and upper, of the stiffening edge 131.

During use the external crown of the bearing 145 is inserted inside a cavity 147 of the second cam element 125, and a ridge 149 made in the cavity 147 allowing the stable coupling of the bearing 145 with the second cam element 125.

The second cam element 125 (FIGS. 25, 26) on the opposite end to that where the support pin 135 is inserted, also has drawing ribs 153, the function of which will be described hereafter.

The second cam element 125 also comprises first fins 151 and second fins 152, lower than the first 151, and conformed to cooperate respectively with the first shaped part 121 and the second shaped part 122 so that (FIG. 22) when the annular cam element 92 is made to rotate by the electric motor 91, each of the second cam elements 125 is made to rotate around the axis of the through hole 130.

Figure 28:
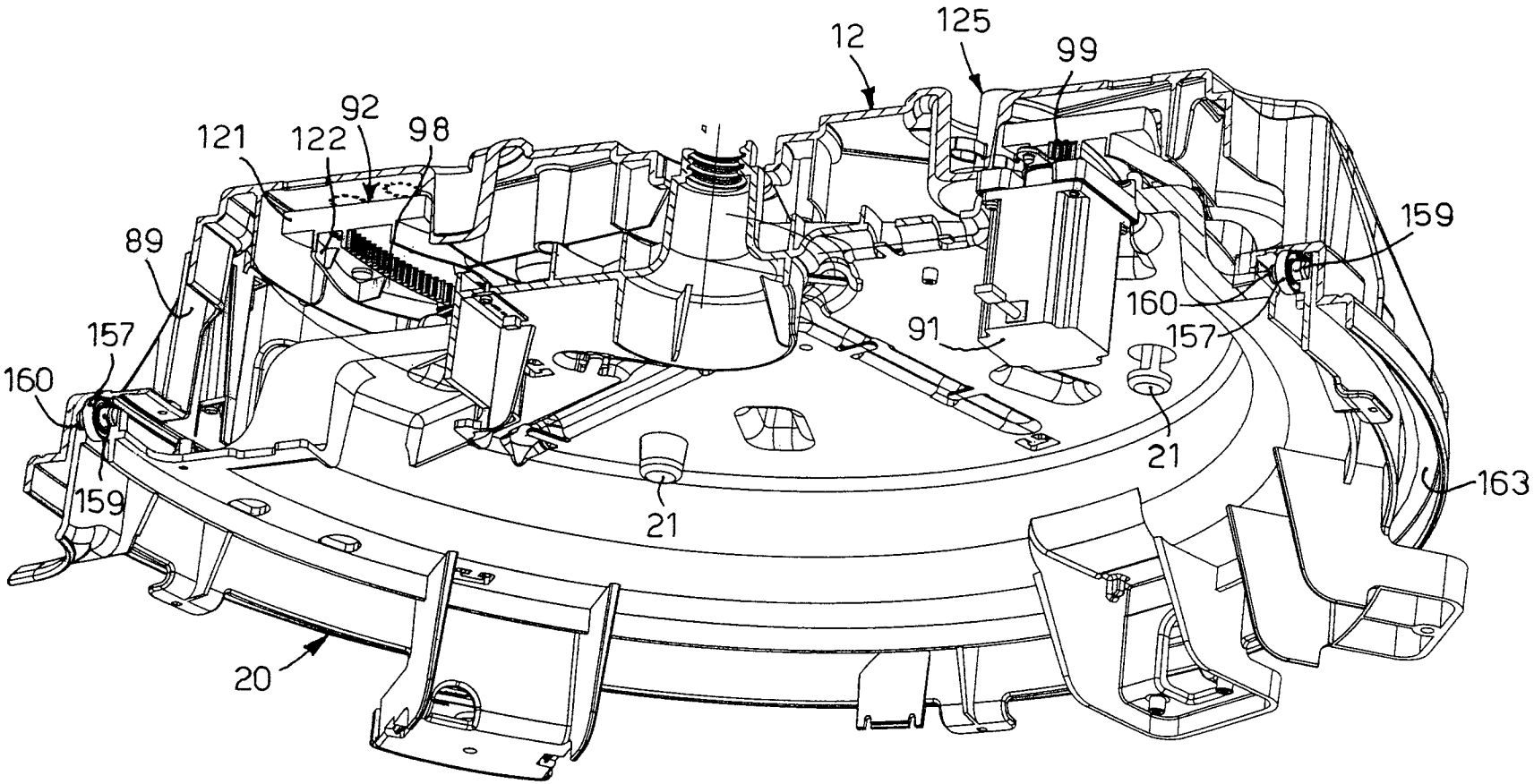
FIG. 28 is a perspective, partly sectioned view of the detail of FIG. 3 in an assembled condition.

The rotatable platform 12, located above the base support 20, is able to slide on bearings 157 (FIGS. 22 and 28) which are associated in proximity with the external edge of the base support 20.

The bearings 157 are mounted on respective pins 159 which in their turn are housed inside supports 160 made in a single body with the base support 20.

The rotatable platform 12 is made to rotate by means of a motor unit 86 (FIG. 2), for example by means of a continuous current motor, the functioning of which is commanded by the processing unit 16, of a known type, in a coordinated manner to one or more specific delivery sequences. The motor can possibly be associated to one or more motor-reducer devices.

In particular, the rotatable platform 12 (FIG. 28) has an external edge 163 in which a rack, not shown in the drawings, is made.

Figure 23B:
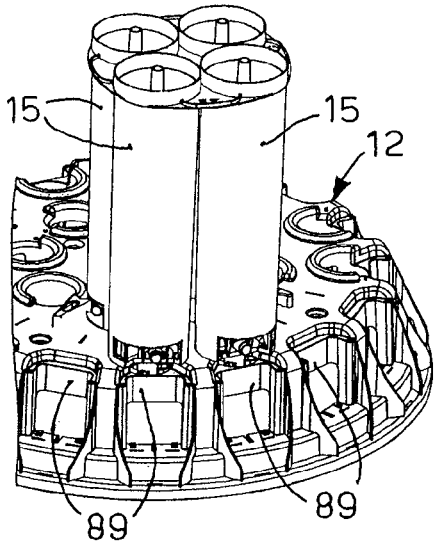
FIG. 23*b* is a perspective view of the details of FIG. 23*a* in an assembled condition.
Figure 23A:
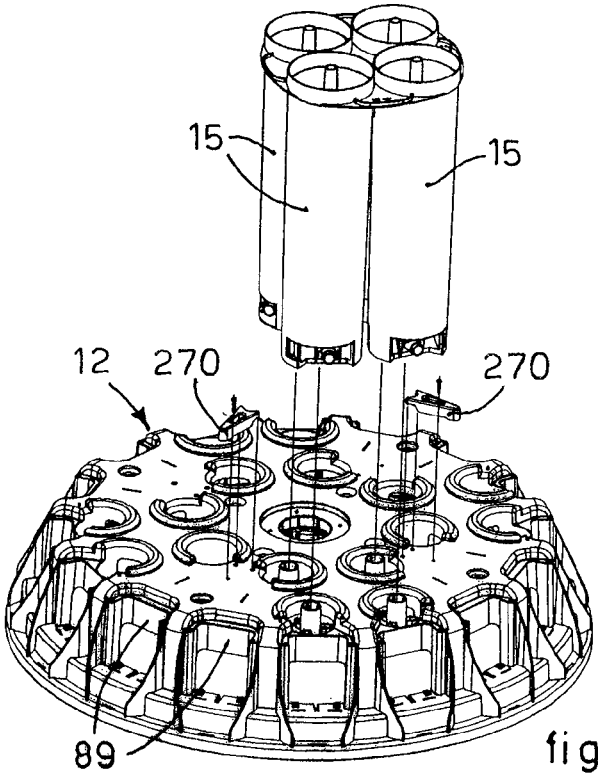

The rotatable platform 12 comprises a plurality of seatings 89 (FIGS. 3 and 23) suitable to accommodate the respective dispensing units 13 which are attached to the rotatable platform 12 in a known manner.

The dispensing units 13 are disposed, with the respective dispensing nozzles 49, circumferentially in proximity to the external edge 163.

The receptacles 15 containing the different fluid products are attached by means of connectors 270 and attachment means of a known type onto the upper surface of the rotatable platform 12, and the dispensing units 13 withdraw the fluid products from the receptacles 15 to achieve a desired composition.

Each receptacle 15, in a known manner, is equipped inside with stirring means to stir the fluid product contained therein. The stirring means comprise a shaft which exits from the lower end of the receptacle and which, during use, cooperates with the second cam elements 125.

Specifically, the drawing ribs 153, provided in the cavity 147 of the second cam element 125, couple with a mating end of the rotation shaft of the stirring means.

Connection tubes 169 (FIG. 2) are provided to connect the delivery mouth of the receptacles to the inlet pipe 50 of the dispensing units 13.

Figure 30:
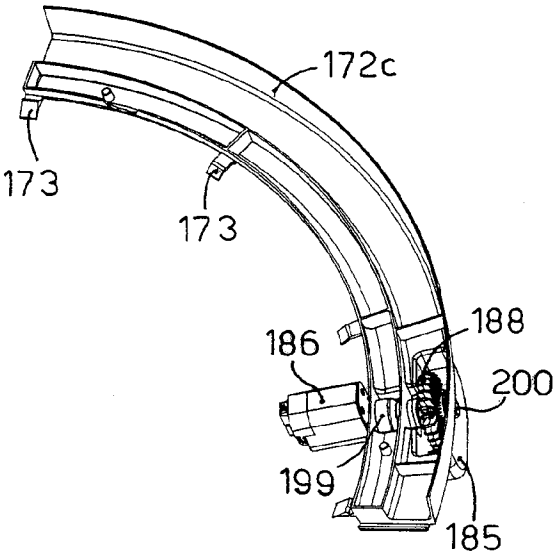
FIG. 30 is a view of a detail of FIG. 29 in an assembled condition.
Figure 29:
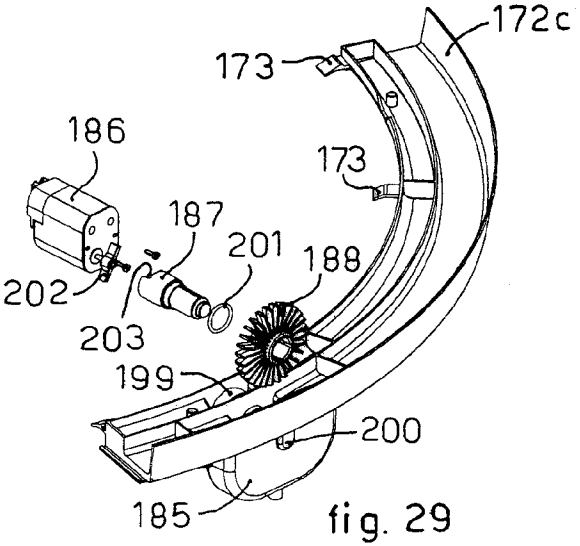
FIG. 29 is an enlarged view of another detail of FIG. 2.
Figure 31:
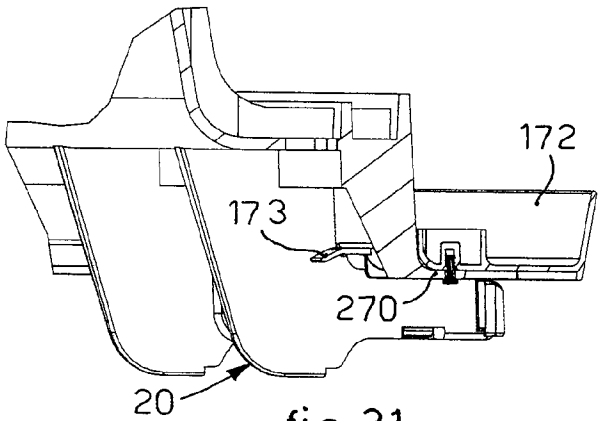
FIG. 31 is a section view of another detail of FIG. 2 in an assembled condition.

The base support 20 is also provided with protuberances 170 (FIGS. 2, 3 and 31) in which attachment holes are made for the attachment of four small drip-catcher channels, respectively 172*a*, 172*b*, 172*c* and 172*d*, which, in their turn, have support brackets 173 (FIGS. 29 and 30) suitable to cooperate with the base support 20 and constrain it to the latter.

The drip-catcher channels 172*a*, 172*b*, 172*c* and 172*d* are conformed to collect any possible residues of fluids which could drip from the dispenser nozzle 49.

The drip-catcher channel 172*c* cooperates with the cleaning means 175 of the dispensing nozzles 49 which comprise an electric motor 186 which makes a cleaning brush 188 rotate around one pin 187.

The drip-catcher channel 172*c* is provided with a containing element or basin 185 to contain liquid and with a first support 199 and a second support 200 of the pin 187, both made in a single body with the drip-catcher channel 172*c*. The first and second support 199 and 200 are disposed coaxially with respect to each other, both between the basin 185 and respectively the first on its internal edge and the second on its external edge.

Specifically, the brush 188 is inserted in the compartment defined by the basin 185 and the pin 87 is inserted subsequently through the first support 199, the hole in the brush 188 and is inserted in the second support 200.

The brush 188 is constrained, in an axial direction to the pin 187, by means of a gripping element 201, in this case an O-ring, while it is constrained to the pin circumferentially by means of interference. In particular, the brush 188 is made completely of rubber and is inserted by interference inside the pin 187 and, given its elasticity, adheres to the surface of the pin 187 remaining constrained to it also by a reciprocal sliding of the pin 187 and brush 188.

The electric motor 186 is provided with a drawing element 202 conformed like a butterfly to cooperate with a mating cavity 203 made in the pin 187, and suitably shaped to the drawing element 202.

The brush 188 is provided with rubber fins which, during use, contact the dispenser nozzle 49 to eliminate possible residues of fluid present on its surface, preventing them from drying up.

The fins of the brush 188 are also suitable to contact the hermetic seal 70 of the dispenser nozzle 49, to deform it so that the residues of the fluid product are discharged from the bottom of the latter. In this way the drying out of the fluid product obstructing the aperture, is prevented.

Given the deformability of the fins of the brush 188, the latter can be disposed in a position of interference with the nozzle dispenser 49, so as to increase the effect of cleaning and vibration which is exerted on the hermetic seal 70.

Figure 32:
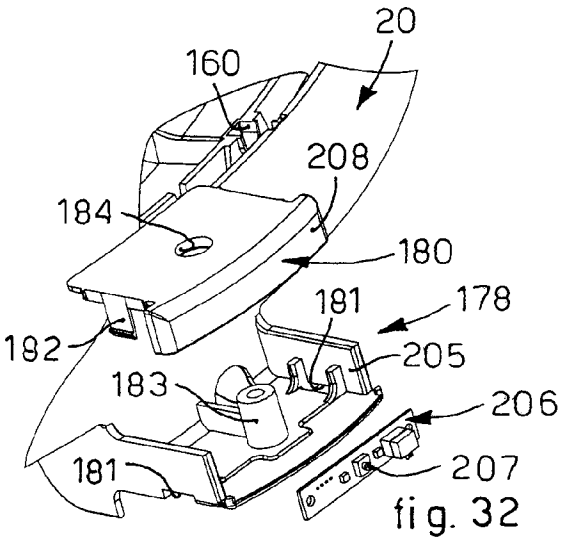
FIG. 32 is an enlarged view of another detail of FIG. 2.

The base support 20 (FIGS. 2 and 32) also comprises two buttons 178 with a substantially rectangular shape disposed protruding and cantilevered on its external edge and which can be selectively actuated by a user to allow to stop the operations for example, which the delivery apparatus 10 is performing.

Each of the two buttons 178 comprises a protruding element 205 made in a single body with the base support 20, an electronic card 206 provided with a switch 207 and a closing cover 180 of the protruding element 205.

Specifically, the protruding element 205 (FIG. 32) is provided with two housing seatings 181, and a centering peg 183 made in a single body with it, whereas the cover 180 is provided on its opposite sides with two attachment teeth 182 which, during use, are inserted inside the housing seatings 181 of the protruding element 205, determining the stable coupling thereof with the latter. The cover 180 also comprises a circular seating 184 suitable to couple with the centering peg 183, when the cover 180 is put in use on the protruding element 205, and anchoring elements, not visible in the drawings, disposed inside, are suitable to keep the electronic card 206 in a pre-fixed position with respect to the protruding element 205.

The cover 180 also comprises a front part 208, which when subjected to thrust by the user, bends and contacts the switch 207 which is attached to it.

In this way when a user finds a condition where it is necessary to stop the delivery operations of the apparatus, by actuating the front part 208 of the cover 180, he activates the switch 207 which, being connected in its turn to the processing unit 16, commands the operations to stop The functioning of the delivery apparatus 10 is described hereafter (FIGS. 1-32).

The user supplies the processing unit 16 with a series of information relating to the fluid product which he wants to obtain, such as for example quantity, composition, shade of color or suchlike, and puts on the bracket 18 a container 17 to contain the fluid product he wants to obtain. In other forms of embodiment this, operation can be governed by automated equipment.

Depending on the information received from the user, the processing unit 16 commands the rotatable platform 12 to rotate, using the motor unit 86.

In this way, one of the dispensing units 13 of the fluid product selected and contained in one of the receptacles 15 is taken into correspondence with the container 17 in order to deliver the fluid product.

When the dispensing unit 13 is disposed in cooperation with the container 17, the two command fins 64 of the cam element 48 are in a substantially horizontal position and in cooperation with the actuation element 44 of the drive unit 39.

The drive unit 39 makes the cam element 48 rotate, in this way driving the bellows pump 45 which provides to suck in the fluid product through the inlet pipe 50 and send it to the dispensing nozzle 49 through the outlet pipe 51. The valves 191 prevent the fluid product from flowing back during the suction and compression steps of the bellows pump 45, respectively through the outlet pipe 51 and the inlet pipe 50.

The quantity of fluid product delivered will depend on the number of revolutions which are imparted to the cam element 48.

When the established quantity of fluid product is reached, the drive unit 39 returns the command fins 64 into a substantially horizontal position, so that these do not prevent the rotation of the rotatable platform 12 by interfering with the actuation element 44 of the drive unit 39.

After the delivery of the fluid product, the rotatable platform 12 is driven in order to bring the nozzle which has just delivered the fluid product into cooperation with the cleaning means 172. When the nozzle 49 is put in correspondence with the brush 188, the electric motor 186 is driven in order to proceed with the cleaning of the nozzle 49.

Subsequently, and in the same way, it is possible to command the positioning of different delivery units 13 in proximity to the container 17 in order to proceed with the delivery of the fluid product until the desired composition is obtained.

During these delivery operations the annular cam element 92 is also made to rotate using the electric motor 91, which makes the second cam element 125 rotate by driving the stirring means present inside the receptacles 15 containing the fluid products.

Detection sensors which detect the position of the rotatable platform 12 and of the dispensing units 13 can be associated to the rotatable platform 12, to the base support 20 or to the annular cam element 92, in order to immediately know their angular positioning, and allow the processing unit 16 a correct formulation of the commands to be given.

Similarly the drive unit 39, associated with the dispensing units 13, can also be provided with suitable sensors to stabilize the quantity of fluid product delivered, depending on the number of revolutions which is imparted to the cam element 48.

It is clear that modifications and/or additions of parts may be made to the apparatus as described heretofore, without departing from the field and scope of the present invention.

It is also clear that, although the present invention has been described with reference to some specific examples, a person of skill in the art shall certainly be able to achieve many other equivalent forms of apparatus, having the characteristics as set forth in the claims and hence all coming within the field of protection defined thereby.

We claim:

1. An apparatus for the delivery of fluid products comprising at least a base support, a plurality of dispensing units of said fluid products contained in containing receptacles by means of respective dispensing nozzles, wherein said dispensing units are disposed on a platform selectively rotatable with respect to said base support, in order to dispose at least one of said dispensing units in at least a first position in which said fluid products are suitable to be delivered from said containing receptacles to a container associated with said base support, by means of a corresponding pumping device, and wherein at least a drive member is disposed on said base support and is suitable to be kinematically connected to one or more pumping devices, wherein first rapid connection means are provided to achieve the connection of at least one of said dispensing nozzles with at least one of said dispensing units, and the connection between first kinematic connection means suitable to be selectively connected to said drive member and second kinematic connection means connected to said pumping device.

2. The apparatus as in claim 1, wherein said first rapid connection means are bayonet connectors, and comprise at least a first seating substantially L shaped and made on a covering element of at least one dispensing unit and at least a peg made on said dispensing nozzle and suitable to be inserted, in a stable manner, inside said first seating by means of a movement first vertical and then rotational.

3. The apparatus as in claim 1, wherein said dispensing nozzle comprises an external body, a cover connected to said external body by means of second rapid connection means and a first hermetic sealing element disposed in a through seating made in the external body and interposed between said external body and said cover and suitable to prevent the drying of said fluid products.

4. The apparatus as in claim 3, wherein said second rapid connection means comprise at least a protrusion made on the external surface of said cover, and at least a corresponding circumferential eyelet conformed to accommodate said at least one protrusion, and to determine a same-shape coupling of said cover and said external body.

5. The apparatus as in claim 3, wherein between said first hermetic sealing element and said external body a spacer element is interposed, suitable to keep in abutment, in said through seating, a second hermetic sealing element against said external body and said first hermetic sealing element against said cover, and wherein third rapid connection means are provided in said spacer element and said second hermetic sealing element, in order to carry out their reciprocal connection.

6. The apparatus as in claim 5, wherein said third rapid connection means comprise at least a first coupling tooth made on the external surface of said spacer element and at least a corresponding circumferential eyelet made on said external body and conformed so as to couple in snap-in mode with said at least one first tooth.

7. The apparatus as in claim 6, wherein said first kinematic connection means comprise an actuator element conformed to selectively couple with said drive member and to be made to rotate by the latter, and said second kinematic connection means comprise a drive element connected to said actuator element and suitable to drive said pumping device, and wherein said first rapid connection means comprise at least a second seating made in said drive element and at least an attachment tooth made in said actuator element.

8. The apparatus as in claim 1, wherein said apparatus comprises a first cam element associated with the platform and suitable to be made to rotate with respect to the platform by means of a first motor associated with the base support, and a plurality of second cam elements, drivable by said first cam element, in order to move stirring means suitable to mix the fluid products contained in said receptacles and wherein at least one of said second cam elements is rotatably associated with said platform by means of fourth rapid connection means.

9. The apparatus as in claim 8, wherein said fourth rapid connection means comprise a support pin for the connection of said second cam element to said platform which is provided at least with a second tooth suitable to connect said support pin in a corresponding hole of said platform.

10. The apparatus as in claim 9, wherein said fourth rapid connection means also comprise a third tooth provided on said support pin suitable to connect to each other said support pin and a bearing suitable to allow the rotation of said second cam element around said support pin and a fourth interference tooth made in said second cam element and suitable to establish a stable coupling of the latter with the bearing.

11. The apparatus as in claim 10, wherein said fourth rapid connection means comprise at least a weakening notch made in proximity to said second tooth and/or said third tooth.

12. The apparatus as in claim 9, wherein said fourth rapid connection means comprise at least a weakening notch made in proximity to said second tooth and/or to a third tooth.

13. The apparatus as in claim 8, wherein said first motor is associated with said base support by means of fifth rapid connection means comprising a shaped seating made in said base support and an interference element conformed substantially like said shaped seating and suitable to assume a first position in which said interference element is suitable to be inserted in said shaped seating, and a second position in which said interference element is suitable to be rotated in order to prevent the removal of said motor from said base support.

14. The apparatus as in claim 13, wherein said base support comprises at least a button which can be selectively activated by a user and comprising a protruding element associated with said base support and suitable to accommodate at least a switch and a cover conformed to allow the selective drive of said switch and wherein sixth rapid connection means are suitable to connect said protruding element and said cover with each other.

15. The apparatus as in claim 13, wherein said base support comprises a plurality of small drip-catcher channels suitable to collect residues of the fluid products delivered by said dispensing nozzles and wherein said drip-catcher channels are provided with seventh rapid connection means suitable to cooperate with said base support and to attach said drip-catcher channels to the latter.

16. The apparatus as in claim 15, wherein at least one of said drip-catcher channels is provided with cleaning means to clean said dispensing nozzles, comprising an element containing cleaning liquid, a brush disposed in said containing element and suitable to contact said dispensing nozzle in order to remove possible fluid delivered, a pin suitable to support said brush in a rotatable manner on supports provided in the containing element and a second motor suitable to make said brush rotate around said pin, and wherein said brush is suitable to be attached to said pin by means of eighth rapid interference connection means.

17. The apparatus as in claim 1, wherein said base support comprises at least a button which can be selectively activated by a user and comprising a protruding element associated with said base support and suitable to accommodate at least a switch, and wherein sixth rapid connection means are suitable to connect said element and said cover with each other.

18. The apparatus as in claim 1, wherein said base support comprises a plurality of small drip-catcher channels suitable to collect residues of the fluid products delivered by said dispensing nozzles and wherein said drip-catcher channels are provided with seventh rapid connection means suitable to cooperate with said base support and to attach said drip-catcher channels to the latter.

* * * * *